US006050190A

United States Patent [19]

Knauer et al.

[11] Patent Number: 6,050,190

[45] Date of Patent: Apr. 18, 2000

[54] DEVICE FOR MOVING TWO DOORS OF A SIDE WALL OF A PRINTING GROUP

[75] Inventors: Peter Knauer, Münster/Lech; Klaus T. Reichel, Augsburg, both of Germany

[73] Assignee: MAN Roland Druckmaschinen AG, Offenbach am Main, Germany

[21] Appl. No.: 09/165,023

[22] Filed: Sep. 30, 1998

[30] Foreign Application Priority Data

Sep. 30, 1997 [DE] Germany ..... 197 43 111

[51] Int. Cl.[7] ..... B41F 5/00

[52] U.S. Cl. ..... 101/216; 101/479

[58] Field of Search ..... 101/216, 218, 101/219, 141, 479, 212, 375, 477, 142, 145

[56] References Cited

U.S. PATENT DOCUMENTS 5,522,316 6/1996 Singler ..... 101/479

FOREIGN PATENT DOCUMENTS 0 352 599 B1 7/1989 European Pat. Off. .
43 32 364 C2 6/1995 Germany .
195 34 651 A1 3/1997 Germany .
196 41 804 4/1998 Germany .
196 41 805 4/1998 Germany .

*Primary Examiner*—Christopher A. Bennett
*Attorney, Agent, or Firm*—Cohen, Pontani, Lieberman, Pavane

[57] ABSTRACT

A device for reliably and economically moving two doors that are movably mounted on a side wall of a printing group in a rotary printing machine for closing openings in the side wall that are proximate printing group cylinders mounted in the printing group, includes a toggle lever articulately connected between each of the two doors and the side wall and is operated by a selectively actuatable working cylinder.

12 Claims, 5 Drawing Sheets

DEVICE FOR MOVING TWO DOORS OF A SIDE WALL OF A PRINTING GROUP

BACKGROUND OF THE INVENTION

1. Field of the Invention

The invention relates to a device for moving two doors on a side wall of a printing group in a rotary printing machine. Sleeve-type printing forms and/or rubber-blanket sleeves are exchangeable through openings that are covered and uncovered by the doors.

2. Description of the Related Art

A prior art device for moving two doors on a side wall of a printing group in a rotary printing machine is disclosed in EP 0 352 599 B1. In that reference, two doors of a printing group are movable between an open and a closed position. When closed, the two doors can receive the journals of two transfer cylinders and two form cylinders. The doors are moved by two motor-operable threaded spindles. When the doors are moved away from each other, openings in the side wall are uncovered through which the printing form and rubber blanket of the form and transfer cylinders may be exchanged.

Other prior art devices for opening doors on printing groups of rotary printing machines are disclosed in references DE 196 41 804 and DE 196 41 805. These references disclose pivotable doors of openings provided in a side wall of a printing group for exchanging the printing forms and the rubber blankets of the cylinders. To operate the doors, six hydraulic working cylinders are provided. A special component is required for preventing the doors from opening on their own if the hydraulic pressure drops. In addition, the doors require expensive bearings, which are also expensive to repair in the event of damage which may, for example, be caused by a winding malfunction.

SUMMARY OF THE INVENTION

The object of the invention is to create a reliable and economically producible device for opening and closing the doors on sidewalls of a printing group of a rotary printing machine.

The object of the invention is attained according to an embodiment of the invention in a device for moving two doors of a sidewall on a printing group of a rotary printing machine with a motor and a toggle lever operably connected to each of the two doors. Each toggle lever is articulately connected between an associated motor and door for moving the door between an open position and a closed position. An opening in the side wall is closable by the two doors such that a journal of one of the printing group cylinders may be supportably received by the doors when the doors are in the closed position.

The toggle levers permit reliable opening and closing of the doors with only two motors which may, for example, comprise working cylinders. Moreover, large closing forces may be applied and the closing position may be simply secured. The closing forces may be established, limited and maintained even during thermal deformation of the printing machine side wall, for example, whereby the function of the closed doors is also reliably maintained.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
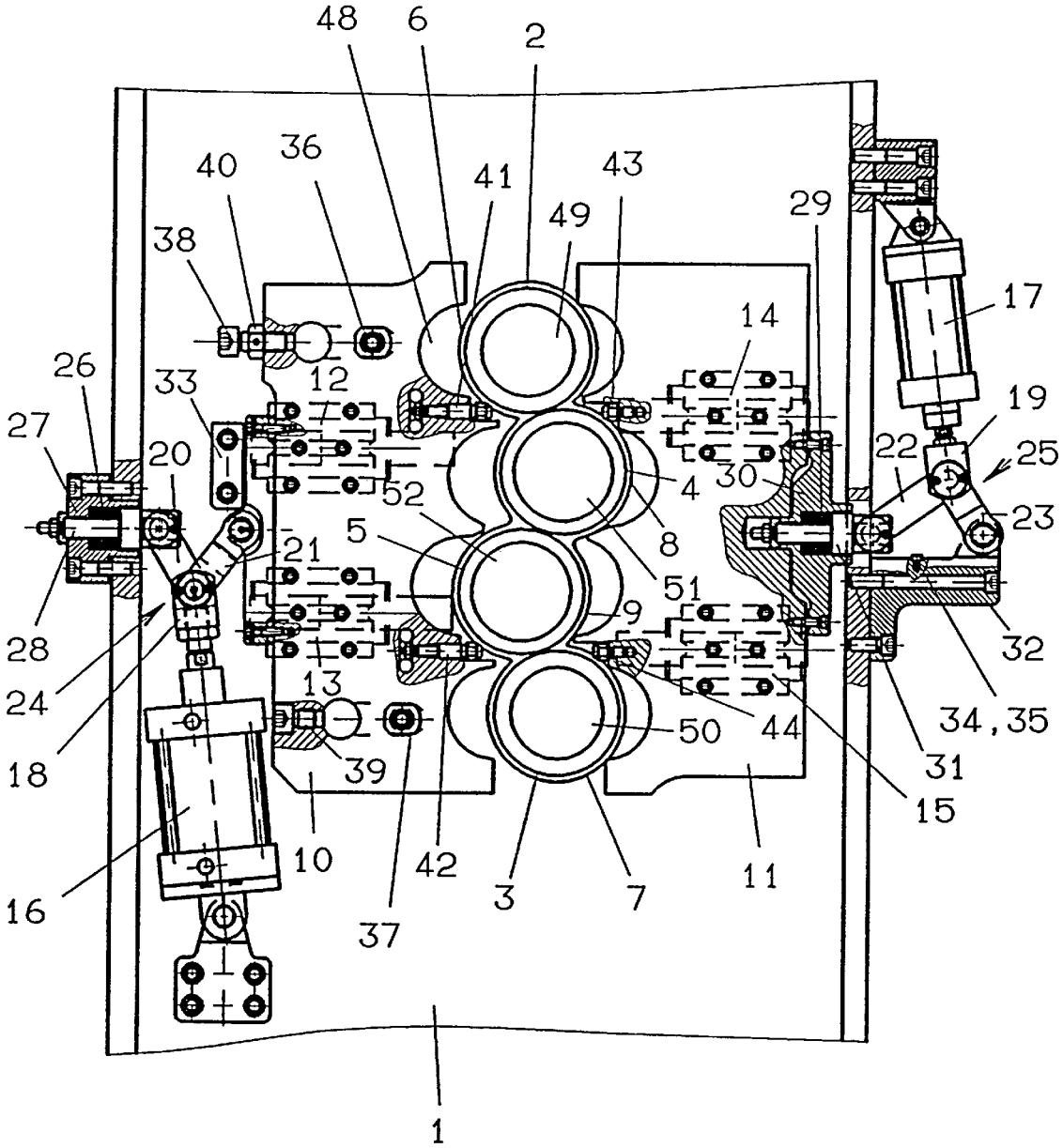
FIG. 1 shows a device for moving two doors on a side wall of a printing group in a rotary printing machine according to an embodiment of the invention with the doors in an open position.

A side wall 1 of a printing group for a rotary printing machine is shown in FIG. 1 in which four printing group cylinders including two form cylinders 2, 3 and two transfer cylinders 4, 5 are mounted. The side wall 1 has openings 6, 7, 8, 9 corresponding to the areas of the respective printing group cylinders 2 to 5. Two doors 10, 11 are movably mounted on the side wall 1 and may be moved for opening and closing the openings 6 to 9.

The doors 10, 11 are mounted on the side wall 1 using standard commercial linear guides. Two linear guides 12, 13 are associated with the door 10 and two linear guides 14, 15 are associated with the door 11. The guide rails of the linear guides 12 to 15 are fastened to the side wall 1, while the associated guide carriages are fastened to the doors 10, 11. The linear guides 12 to 15 are embodied without play so that only linear motion of the doors 10, 11 is possible. The linear guides 12 through 15 are also economical and are easily exchanged if damaged.

For moving the doors 10, 11, a pneumatic working cylinder 16, 17 is respectively connected to each door 10, 11. Instead of pneumatic working cylinders, other types of motors such, for example, as hydraulic working cylinders and electric lifting magnets could also be used. In the embodiment shown in FIG. 1, the working cylinder 16 is arranged in articulated fashion on the side wall 1. The working cylinder 17 is also arranged in articulated fashion on a frame of the side wall 1, which is embodied as a box wall. A toggle lever 24 including levers 20 and 21 is articulately connected to a piston rod head 18 of the working cylinder 16. In toggle lever 24, the lever 21 is articulately connected to the door 10 and the lever 20 is supported on side wall 1. An intermediate connection of a packet of disc springs 26 is mounted between lever 20 and the side wall 1 in a housing 27 fastened to the side wall 1. Instead of disc springs, other types of springs may also be used. The disc springs 26 are stressed by a spring plate 28 to which the lever 20 is articulately attached. Another toggle lever 25 including levers 22, 23 is articulately connected to a piston rod head 19 of the working cylinder 17. In toggle lever 25, the lever 22 acts on door 11 with intermediate connection of a packet of disc springs 29. The disc springs 29 are located in a housing 30 which is fastened to the door 11. The disc springs 29 are acted upon by a spring plate 31 which is articulately attached to the side wall 1. The lever 23 is articulately supported on the side wall 1 by being pivotably mounted on a bearing 32 screwed to the side wall 1. The disc springs 26 of toggle 24 may be arranged in a force-locking fashion between the toggle lever 24 and the side wall 1, similarly to the disc springs 29 of toggle lever 25, and vice versa.

The piston rod heads 18, 19 are preferably embodied as forked heads, with the respective levers 20, 21 and 22, 23 arranged between the forked portion of the forked heads. Instead of forked piston rod heads 18, 19, one of the levers such, for example, as lever 21 for toggle lever 24 or lever 23 for toggle lever 25, may be embodied as a forked lever. These embodiments of the forked heads are not shown in a separate top view, because they are familiar to experts.

Figure 2:
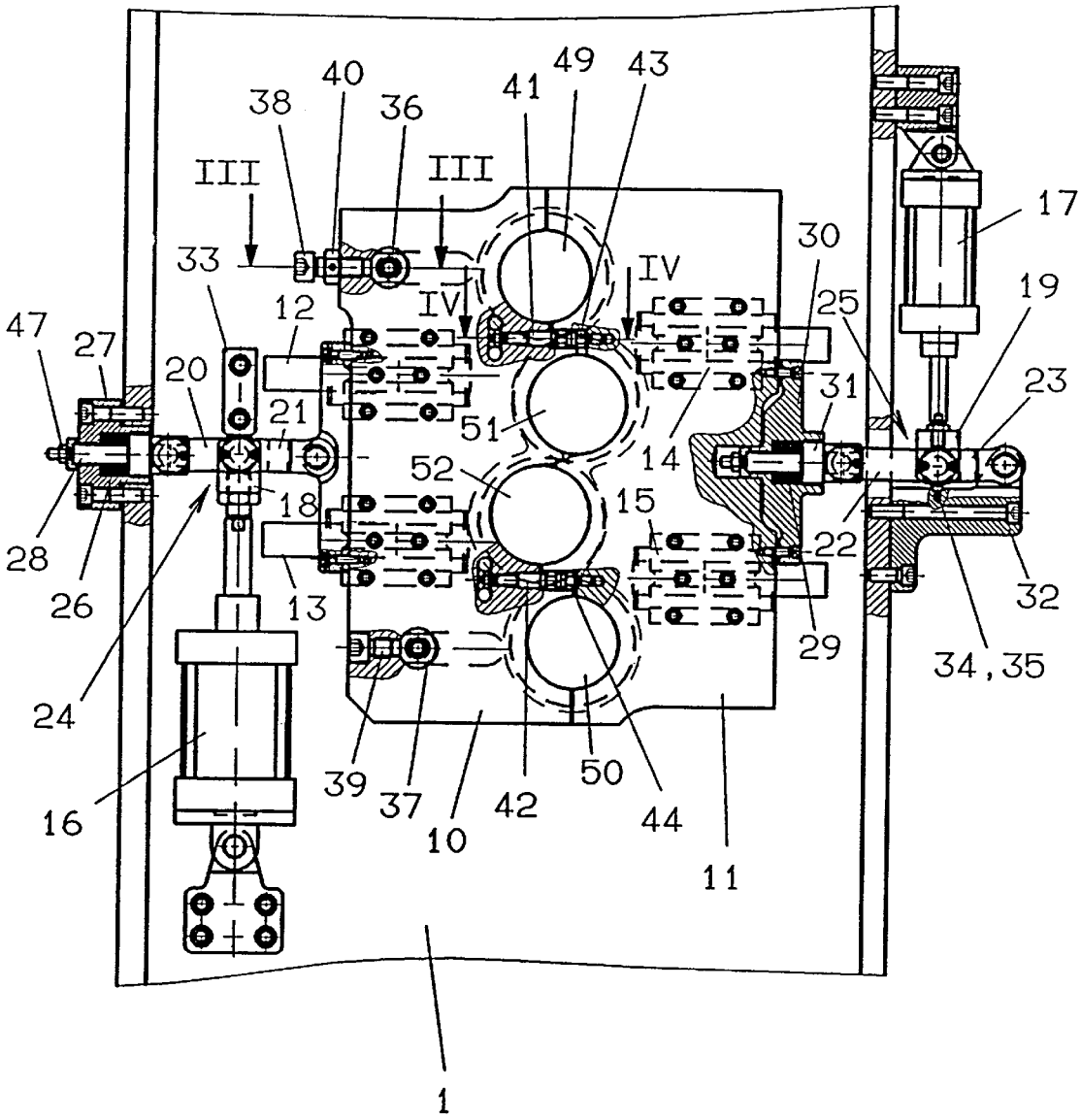
FIG. 2 shows the device of FIG. 1, with the doors in a closed position.
Figure 3:
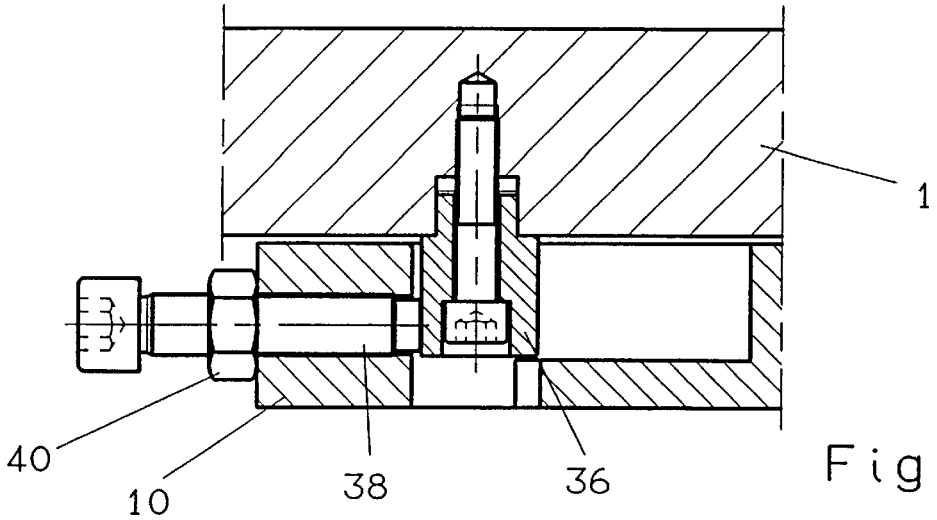
FIG. 3 is a sectional view through line III—III of the device in FIG. 2.

Referring now to FIG. 2, the toggle levers 24, 25 assume over dead center positions in their extended position such that the hinge point of the levers 20, 21 can be moved slightly upward past the extended position, while the hinge point of the levers 22, 23 can be moved slightly downward past the extension position. The over dead center positions are limited by stops 33, 34. An adjustment screw 35 for adjustment of the stop 34 is also shown. When the doors 10, 11 are moved into the closed position as shown in FIG. 2, a stop system is used for precise positioning of the doors as follows. Door 10 is moved into the closed position against stops 36, 37 arranged on the side wall 1. The door 10 carries counterstops 38, 39, which interact with the stops 36, 37. Counterstop 38 is adjustable, so that counterstop 38 contacts stop 36 at the same time that counterstop 39 contacts stop 37 as in FIG. 3. The setting of the counterstop 38 may be locked by a nut 40.

Figure 4:
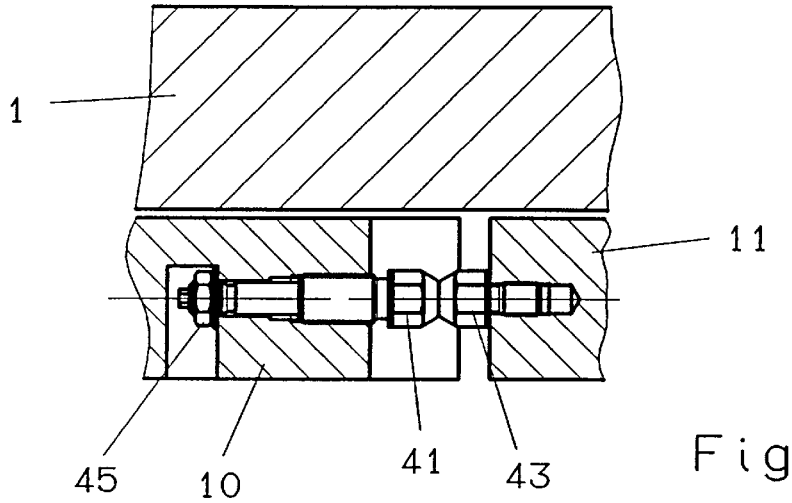
FIG. 4 is a sectional view through line IV—IV of the device in FIG. 2.

Also arranged on the door 10 are stops 41, 42 which interact with counterstops 43, 44 on the door 11 shown in FIGS. 1 and 4. The stops 41, 42 are adjustable and can be locked by nuts 45. The doors 10, 11 are moved toward each other until stops 41, 42 contact counterstops 43, 44. The adjustability of the stops 41 to 44 and the stops 36 to 39 permits compensation for manufacturing tolerances.

Figure 5A:
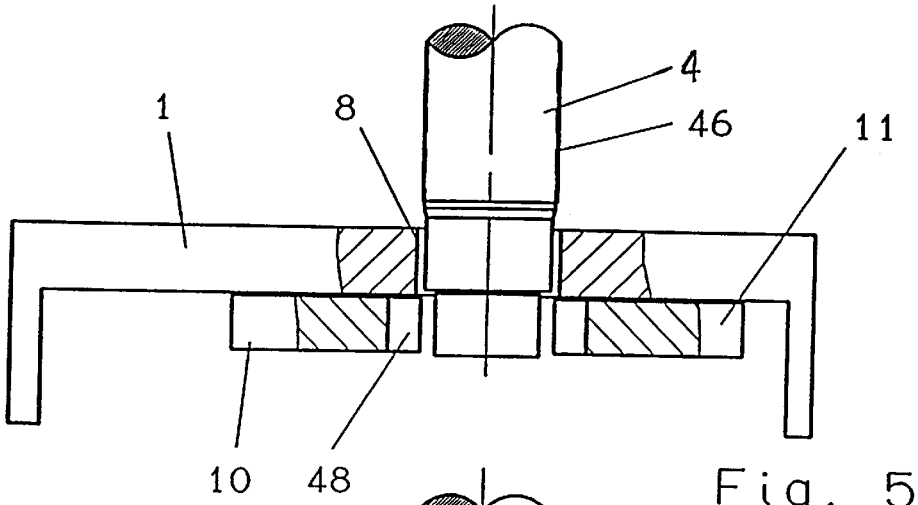
FIG. 5*a* is a top view of the side wall and the doors and one printing group cylinder of the printing unit of FIG. 1 with the doors in the open position.

In FIG. 1, the doors 10, 11 are in the opened position. The working cylinders 16, 17 are retracted in this position and the bent toggle levers 24, 25 have moved the doors 10, 11 into the illustrated position. This opened position is also shown in FIG. 5*a*. The uncovered openings 6 to 9 in the side wall 1 allow sleeve-type printing forms and rubber-blanket sleeves, in particular, to be removed from or placed onto the form cylinders 2, 3 and transfer cylinders 4, 5. Of course, endless printing forms and endless rubber blankets, for example, may also be 20 changed through the openings 6 to 9, as disclosed in DE 44 07 758 C2. FIG. 5*a* shows the transfer cylinder 4 with the uncovered opening 8, for example. In the opened position of the doors 10, 11, the printing group cylinders 2 to 5 are held in the illustrated floating position by a support device (not shown) located in the other side wall. Such support devices are known from the prior art and thus require no further explanation.

Figure 5B:
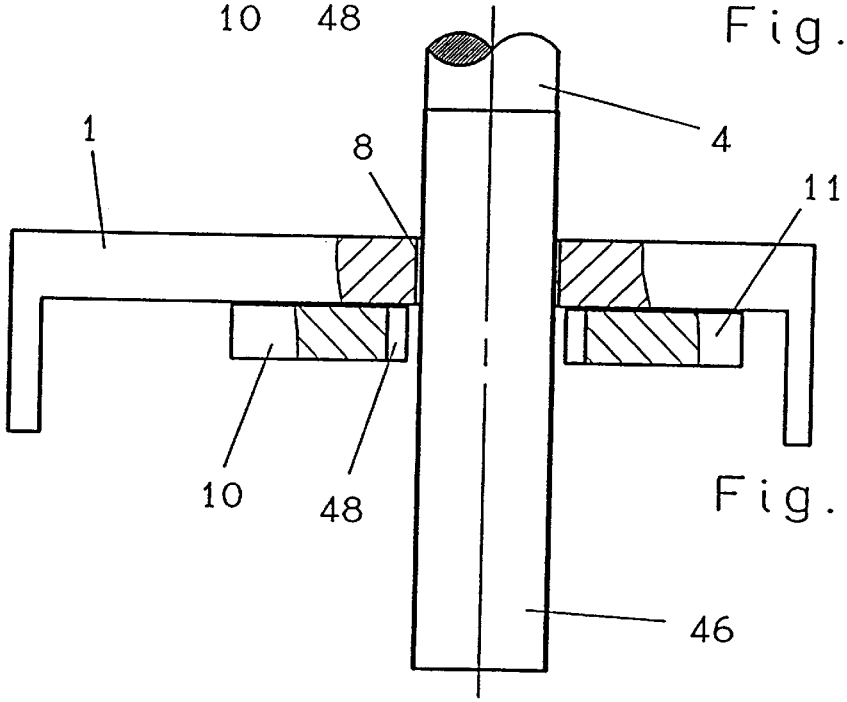
FIG. 5*b* is a top view of the side wall and the doors and one printing group cylinder of the printing unit of FIG. 1 with the doors in the open position and a sleeve of the cylinder being changed.

FIG. 5*b* shows a rubber-blanket sleeve 46 being exchanged through the opening 8 with the doors 10, 11 in the opened position.

Figure 5C:
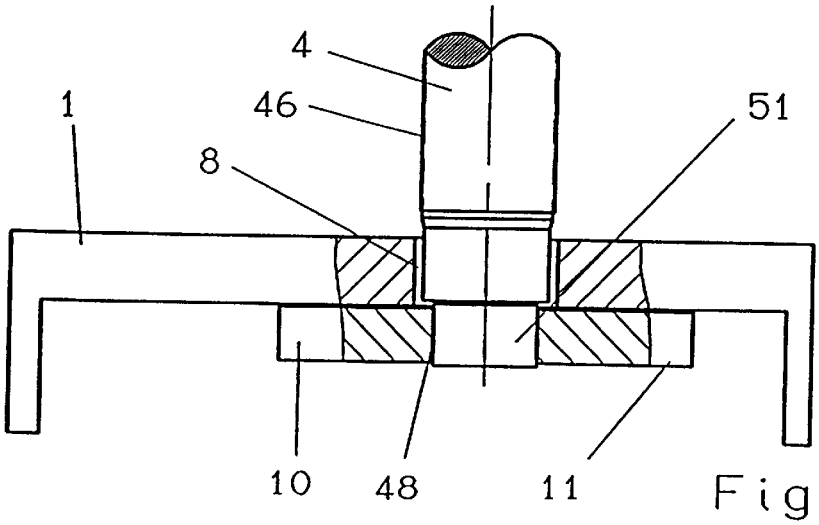
FIG. 5*c* is a top view of the side wall and the doors and one printing group cylinder of the printing unit of FIG. 1 with the doors in the closed position.

After the printing form or rubber-blanket sleeve 46 is exchanged, the doors 10, 11 are moved into the closed position shown in FIGS. 2 and 5*c*. For moving the door 10 to the closed position, the working cylinder 16 is first reversed and when its piston rod 18 is moved outward, the toggle lever 24 is extended toward its fully extended position. The first door 10 thereby moves on the linear guides 12, 13 until its counterstops 38, 39 strike the stops 36, 37. The toggle lever 24 is moved toward its over dead center position, until coming to rest on the stop 33. The disc springs 26 are set by an adjustable nut 47 on the threaded journal of the spring plate 28 to a certain prestress force. The disc spring packet 26 is designed such that, when the toggle lever assumes the over dead center position, there is only slight additional deflection. A The door 10 is thus positioned on the stops 36 and 37 with an exactly defined prestress force.

Once the door 10 is in the closed position, the door 11 is then moved toward the positioned door 10. For this purpose, the working cylinder 17 is reversed, and the toggle lever 25 moves toward the extended position, thereby moving the door 11 to the closed position. The counterstops 43, 44 of the door 11 strike the stops 41, 42 of the door 10. The disc springs 29, which are already prestressed at a certain force, are thereupon deflected to a slightly greater extent. Based on the selected spring prestress of the disc springs 29, the door 11 is moved toward the door 10 with a defined force. The disc springs 29 are thereby prestressed with less force than the disc springs 26, so that the door 11, upon contacting the door 10, does not move the door 10 off the stops 36, 37. An advantageous ratio of the prestress forces of the disc springs 26 and 29 is approximately 2:1. The disc springs 26, 29 also limit the forces produced by the toggle levers 24, 25, and thus furnish a reliable basis for calculation and component design such as for stops and bearings. In addition, the disc springs 26, 29 enable the printing group cylinders 2 to 5 to yield in the event of winding malfunctions, and thus help to prevent printing group damage.

Without requiring additional components, the over dead center positions secure the doors 10, 11 in the closed position, even in the event of a pressure failure of the fluid that operates the working cylinders 16 and 17. Furthermore, thanks to the stop system, differing heat expansions between the side wall 1 and the doors 10 and 11 are well compensated for; this is because, when the position of the first door 10 changes, the door 11 follows the door 10. Thus, even when the position of the frame-fixed stops 36, 37 changes, for example, due to heat, the diameters and axial distances of the bearing borings 48, and thus the desired toward-and-away positioning ratios of the transfer cylinders 4, 5 are maintained. This is an important precondition for good print quality. The positioning forces of the doors 10, 11 are also maintained by the disc springs 26, 29. The journals of the pressure cylinders 2 to 5 are advantageously mounted in the doors 10, 11 by bushings 49 to 52, in which the actual cylinder bearings are located. When closed, the doors 10, 11 are thus clamped in their bearing borings 48 by the bushings 49 to 52 as in FIG. 5*c*.

Figure 7:
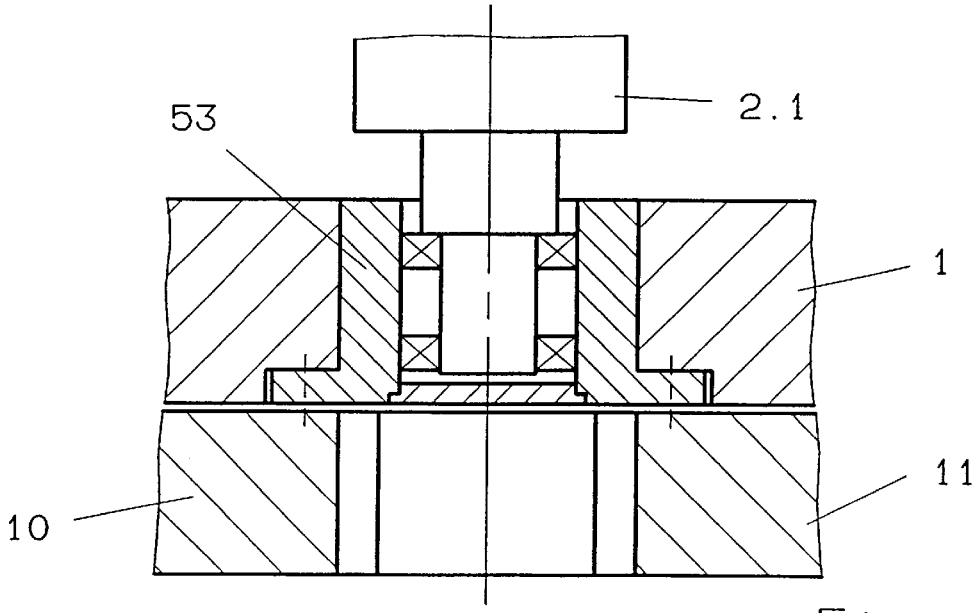
FIG. 7 is a sectional view through line VII—VII of the device in FIG. 6.
Figure 6:
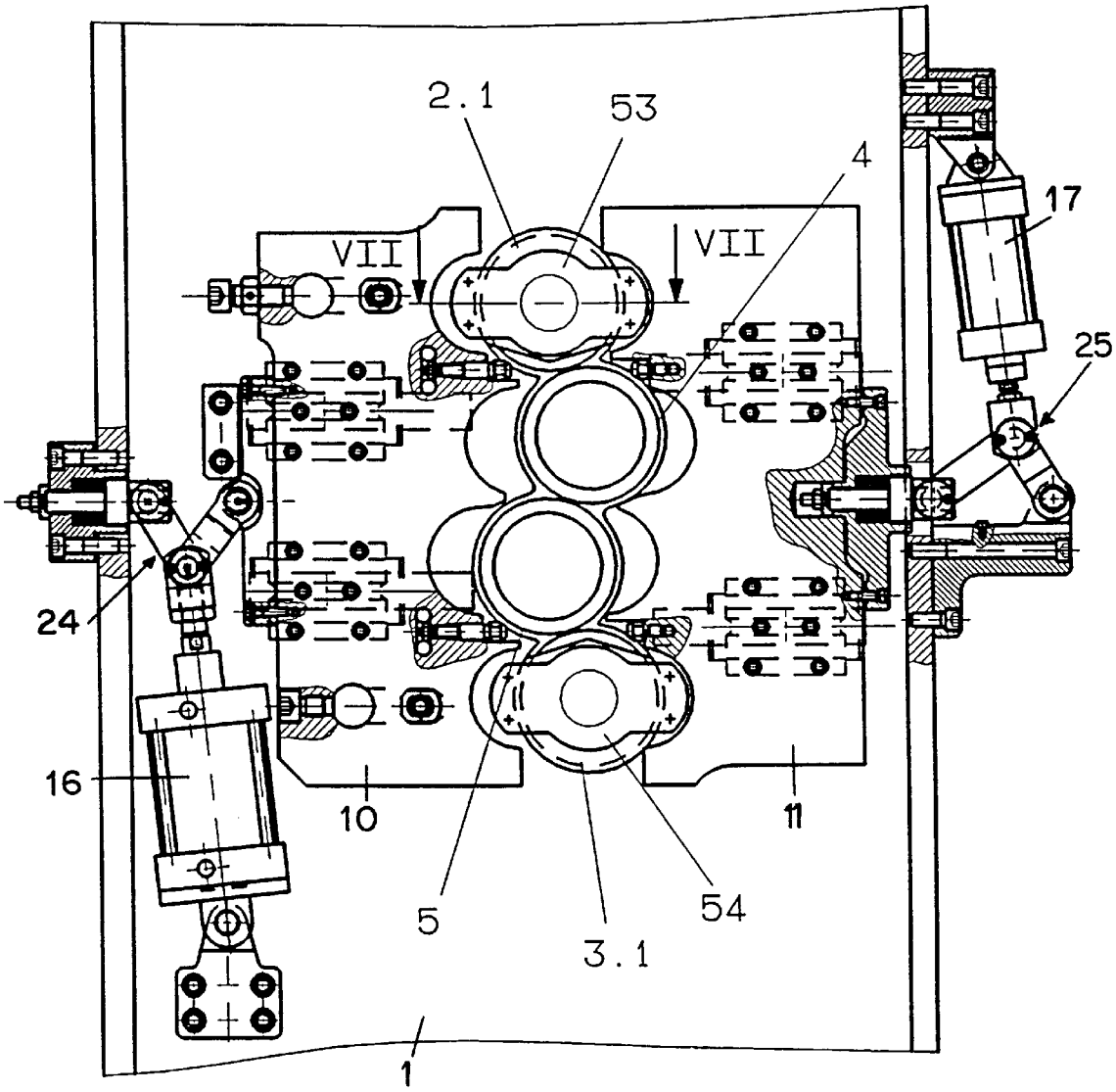
FIG. 6 is a view of the device of FIG. 1 with cheeks inserted in openings of the side walls at the form cylinders.

The doors 10, 11 may also be embodied such that only the journals of the transfer cylinders 4, 5 are mountable therein. In that embodiment, the side wall 1 has no openings in the area of the form cylinders 2, 3, for example, and the form cylinders 2, 3 carry no sleeve-type printing forms. The doors 10, 11 should then be designed, with respect to height, so as to cover only the area around the transfer cylinders 4, 5. It is also possible to mount the printing group cylinders 2 to 5 in the doors 10, 11 or in the side wall 1, at option, depending on whether these cylinders 2 to 5 are embodied to hold a sleeve-type cover or an endless cover. FIGS. 6 and 7 show an embodiment in which the form cylinders 2.1 and 3.1 carry an endless printing form. In this case, cheeks 53, 54 are placed in the openings 6, 7 and screwed to the side wall 1 (see FIG. 7). The form cylinders 2.1, 3.1 are supportably mounted in the cheeks 53, 54. When the doors 10, 11 are in the closed position (not shown), their bearing borings 48 have no function in the area of the form cylinders 2.1, 3.1. That is, only the bushings 51, 52 of the transfer cylinders 4, 5 are supportably clamped by the doors 10, 11. The printing groups as shown in FIGS. 6 and 7 are easily converted to include form cylinders 2, 3 with sleeve-type printing forms by removing the cheeks 53, 54 and replacing the form cylinders 2.1, 3.1 with form cylinders 2, 3 having sleeve-type printing forms. The conditions shown in FIGS. 1 and 2 then apply once more. The printing group shown in FIG. 7 otherwise resembles that shown in FIGS. 1 and 2.

The invention is not limited by the embodiments described above which are presented as examples only but can be modified in various ways within the scope of protection defined by the appended patent claims.

We claim:

1. An assembly for moving two doors that are movably mounted on a side wall of a printing group in a rotary printing machine, the two doors being movable between an open position and a closed position for opening and closing an access opening in the side wall proximate a printing group cylinder supportably mounted in the printing group, said assembly comprising:

a first toggle lever having two levers joined at a toggle joint and articulately connectable between the side wall and one of the two doors;

a second toggle lever having two levers joined at a toggle joint and articulately connectable between the side wall and the other of the two doors;

a first selectively actuatable motor operatively connected to said toggle joint of said first toggle lever for moving the one of the two doors; and a second selectively actuatable motor operatively connected to said toggle joint of said second toggle lever for moving the other of the two doors.

2. The assembly of claim 1, wherein each said first and second toggle levers assumes a over dead center position when the two doors are in the closed position.

3. An assembly for moving two doors that are movably mounted on a side wall of a printing group in a rotary printing machine, the two doors being movable between an open position and a closed position for opening and closing an access opening in the side wall proximate a printing group cylinder supportably mounted in the printing group said assembly comprising:

a first toggle lever articulately connectable between the side wall and one of the two doors;

a second toggle lever articulately connectable between the side wall and the other of the two doors;

a first selectively actuatable motor operatively connected to said first toggle lever for moving the one of the two doors;

a second selectively actuatable motor operatively connected to said second toggle lever for moving the other of the two doors;

first and second stops arrangable on the side wall for contacting one of the two doors when the one of the two doors is in the closed position; and third and fourth stops arrangable on the one of the two doors such that said third and fourth stops contact the other of the two doors when the two doors are in the closed position.

4. The assembly of claim 3, further comprising first and second prestressed springs operatively connected to said respective first and second toggle levers for imparting a prestress to each respective door when the respective door is in the closed position, wherein said first spring is prestressed with a larger force than said second spring.

5. The assembly of claim 1, wherein said first and second motors comprise first and second working cylinders each having a first end supportable on the side wall and a second end articulately connected to a respective one of said first and second toggles.

6. The assembly of claim 1, further comprising cheek means for closing the opening of the side wall proximate the printing group cylinder, said cheek means being insertable into the side wall for supportably receiving the printing group cylinder.

7. The assembly of claim 1, further comprising linear guides operatively connectable between the doors and the side wall for guiding the movement of the two doors between the open position to the closed position.

8. The assembly of claim 3, wherein each said first and second toggle levers assumes an over dead center position when the two doors are in the closed position.

9. The assembly of claim 3, wherein said first and second motors comprise first and second working cylinders each having a first end supportable on the side wall and a second end articulately connected to a respective one of said first and second toggles.

10. The assembly of claim 3, further comprising cheek means for closing the opening of the side wall proximate the printing group cylinder, said cheek means being insertable into the side wall for supportably receiving the printing group cylinder.

11. The assembly of claim 3, further comprising linear guides operatively connectable between the doors and the side wall for guiding the movement of the two doors between the open position to the closed position.

12. A process for closing two doors movably mounted on a side wall of a printing group in a rotary printing machine, for closing an access opening in the side wall proximate a printing group cylinder, the process comprising the steps of:

moving a first one of the two doors against stops arranged on the side wall; and moving a second one of the two doors against the first door such that a journal of the printing group cylinder supportably clamped between the two doors.

* * * * *